US007228698B2

(12) United States Patent
Sanders

(10) Patent No.: US 7,228,698 B2
(45) Date of Patent: Jun. 12, 2007

(54) REFRIGERATION UNIT

(75) Inventor: Joseph F. Sanders, North Richland Hills, TX (US)

(73) Assignee: Premark FEG L.L.C., Wilmington, DE (US)

( * ) Notice: Subject to any disclaimer, the term of this patent is extended or adjusted under 35 U.S.C. 154(b) by 183 days.

(21) Appl. No.: 11/171,660

(22) Filed: Jun. 30, 2005

(65) Prior Publication Data

US 2007/0000273 A1 Jan. 4, 2007

(51) Int. Cl.
*F25D 21/14* (2006.01)

(52) U.S. Cl. ..... 62/288; 62/385

(58) Field of Classification Search ..... 62/277, 62/285, 288, 289, 291, 385, 450
See application file for complete search history.

(56) References Cited

U.S. PATENT DOCUMENTS

| | | | | |
|---|---|---|---|---|
| 1,537,601 | A | 5/1925 | Groh | |
| 3,111,818 | A | 11/1963 | Dolan et al. | |
| 3,421,338 | A | 1/1969 | Gidseg | |
| 3,486,347 | A | 12/1969 | Gidseg | |
| 4,089,187 | A | 5/1978 | Schumacher et al. | |
| 4,783,971 | A | 11/1988 | Alba | |
| 4,882,911 | A | 11/1989 | Immel | |
| 4,918,940 | A * | 4/1990 | Buckley | 62/285 |
| 4,979,377 | A * | 12/1990 | Fievet et al. | 62/274 |
| 5,341,653 | A | 8/1994 | Tippmann et al. | |
| 5,966,958 | A * | 10/1999 | Maynard | 62/277 |
| 6,085,539 | A * | 7/2000 | Meyer | 62/285 |
| 6,437,851 | B2 * | 8/2002 | Hagiwara | 355/30 |
| 6,701,739 | B2 * | 3/2004 | Morse | 62/277 |
| 6,883,336 | B2 * | 4/2005 | Dudley et al. | 62/115 |
| 7,065,977 | B2 * | 6/2006 | Upton et al. | 62/246 |
| 7,107,786 | B2 * | 9/2006 | Manole | 62/426 |
| 2003/0230104 | A1 * | 12/2003 | Morse | 62/277 |
| 2004/0060319 | A1 | 4/2004 | Wood | |
| 2004/0079105 | A1 | 4/2004 | Wood | |
| 2004/0211212 | A1 | 10/2004 | Wood | |

FOREIGN PATENT DOCUMENTS

| | | | |
|---|---|---|---|
| EP | 1008818 | A2 * | 6/2000 |
| EP | 1371922 | | 12/2003 |

* cited by examiner

*Primary Examiner*—Mohammad M. Ali
(74) *Attorney, Agent, or Firm*—Thompson Hine LLP

(57) ABSTRACT

A refrigeration unit includes an evaporator assembly including an evaporator coil forming a first part of a refrigerant path. A condenser assembly is at least partially disposed in a compartment in a housing and includes a condenser coil forming a second part of the refrigerant path. A condensate pan is arranged and configured to receive condensate having dropped from the evaporator assembly. The condensate pan has a first portion that is exposed to pressure conditions in the compartment and a second portion that is spaced away from the compartment and exposed to ambient pressure.

23 Claims, 4 Drawing Sheets

REFRIGERATION UNIT

TECHNICAL FIELD

The present application relates generally to refrigeration systems, and more particularly to a refrigeration assembly including a condenser assembly with condensate pan arrangement.

BACKGROUND

Refrigerators are used in numerous settings, such as in a commercial setting or in a domestic setting. Typically, refrigerators are used to store and maintain food products by providing a cooled environment into which the products can be stored. Refrigeration systems typically include a refrigeration cabinet into which the food products are placed and a refrigeration assembly for cooling the air and products in the refrigeration cabinet.

The refrigeration assembly often includes an evaporator assembly and a condenser assembly, each forming a portion of a refrigerant loop or circuit. The refrigerant is used to carry heat from air within the refrigeration cabinet. The refrigerant picks up heat in the evaporator assembly and then gives off heat in the condenser assembly.

Because the evaporator assembly is used to cool air, moisture carried by the air often condenses on the evaporator assembly. As moisture accumulates on the evaporator assembly, it drips from the assembly due to gravity. A condensate tray may be included for collecting moisture having dripped from the evaporator assembly. The condensate tray is sometimes located near the condenser assembly, remote from the evaporator assembly to facilitate evaporation of condensate disposed therein.

SUMMARY

In an aspect, a refrigeration unit includes an evaporator assembly including an evaporator coil forming a first part of a refrigerant path. A condenser assembly is at least partially disposed in a compartment in a housing and includes a condenser coil forming a second part of the refrigerant path. A condensate pan is arranged and configured to receive condensate having dropped from the evaporator assembly. The condensate pan has a first portion that is exposed to pressure conditions in the compartment and a second portion that is spaced away from the compartment and exposed to ambient pressure.

In another aspect, a refrigeration unit includes an evaporator assembly including an evaporator coil forming a first part of a refrigerant path. A condenser assembly is at least partially disposed in a compartment in a housing and includes a condenser coil forming a second part of the refrigerant path and a condenser fan for drawing air past the condenser coil. A condensate pan is arranged and configured to receive condensate having dropped from the evaporator assembly. The condensate pan has a first portion exposed to the compartment that is at the downstream side of the condenser fan, wherein operation of the condenser fan creates an increased pressure condition in the compartment. A second portion of the condensate pan is spaced away from the compartment and exposed to ambient atmosphere such that the first portion of the condensate pan is exposed to the increased pressure condition and the second portion of the condensate pan is exposed to lower ambient pressure.

In another aspect, a method of evaporating moisture collected in a condensate pan of a refrigeration unit including an evaporator assembly including an evaporator coil and a condenser assembly including a condenser coil at least partially disposed in a housing is provided. The method includes exposing a first portion of the condensate pan to a high pressure condition within a compartment at least partially housing the condenser assembly, the condensate pan arranged and configured to receive moisture having dripped from the evaporator assembly during a refrigeration operation. A second portion of the condensate pan is exposed to ambient pressure creating a pressure gradient across the condensate pan by spacing the second portion from the compartment.

DETAILED DESCRIPTION

Figure 1:
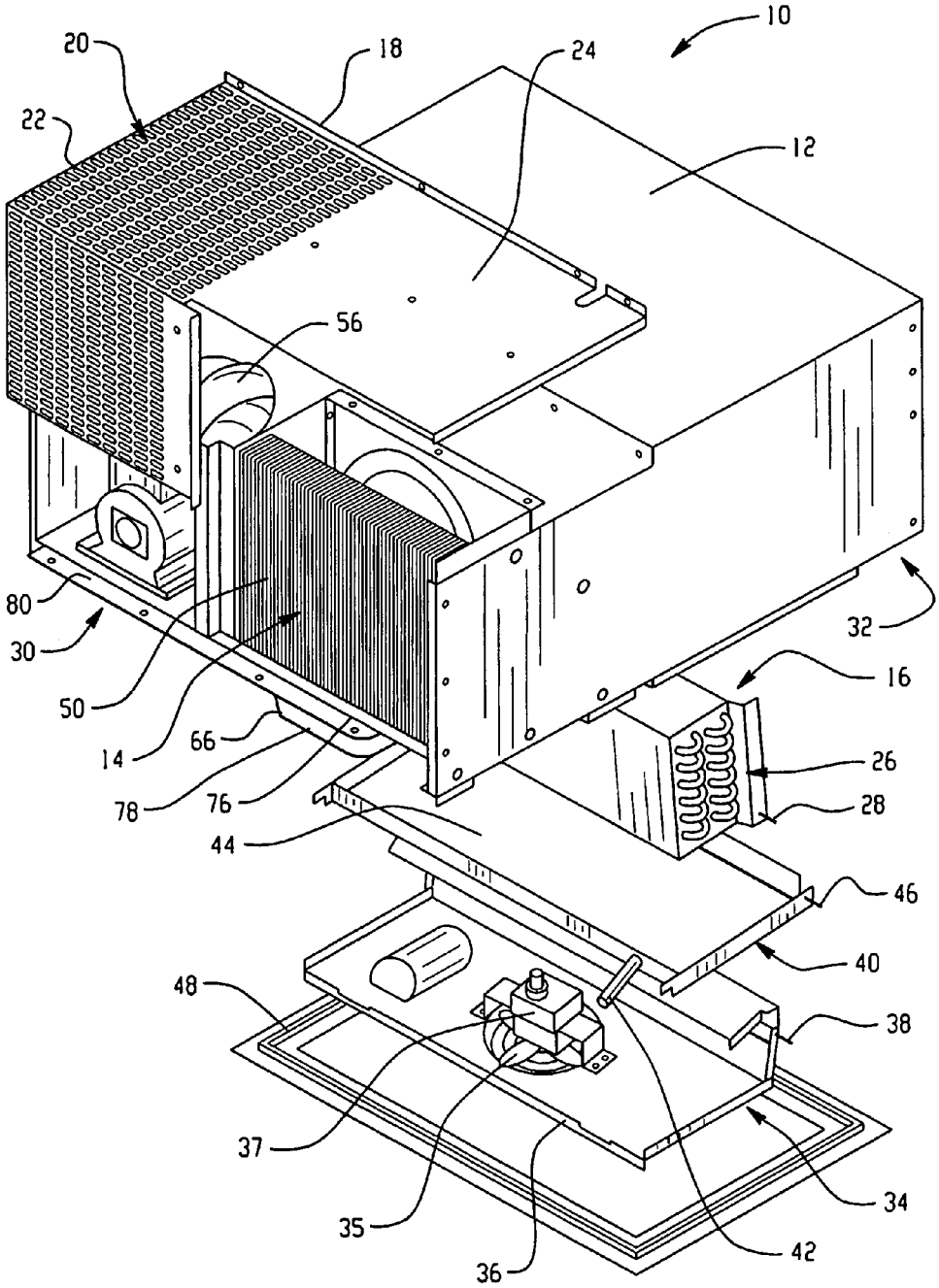
FIG. 1 is an exploded, perspective view of an embodiment of a refrigeration module.

Referring to FIG. 1, a refrigeration module 10 for use with a refrigeration appliance such as a vending machine, refrigerator, freezer, etc. includes a housing 12 having a compartment 30 housing a condenser assembly 14 and another, insulated compartment 32 housing an evaporator assembly 16. A cover 18 connects to the housing 12 to at least partially enclose components of the condenser assembly 14 within housing 12. Cover 18 has a first section 20 that includes louvers 22 that allow air passage therethrough and a second, solid section 24 that inhibits air passage therethrough. As will be described in greater detail below, refrigeration module 10 includes a condensate pan 66 having a first portion 68 exposed to the compartment 30 and a second portion 78 that is spaced from the compartment 30 and exposed to the atmospheric conditions.

Evaporator assembly 16 includes an evaporator coil 26 including mounting structure 28 for use in mounting the evaporator coil 26 within the compartment 32 and a fan assembly 34 for circulating air over the evaporator coil 26. Fan assembly 34 includes a fan 35, a fan motor 37 operatively connected to the fan 35 and a fan shroud 36 having mounting structure 38 that is used to mount the fan assembly in the compartment 32. A drain pan assembly 40 is located to receive moisture falling from the evaporator coil 26. Drain pan assembly 40 includes mounting structure 46 that is used to mount the drain pan assembly within the compartment 32 and beneath the evaporator coil 26 and a drain conduit 42 for directing accumulated moisture (i.e., condensate) from drain pan 44. A gasket 48 seals the evaporator assembly 16 within housing 12.

Figure 2:
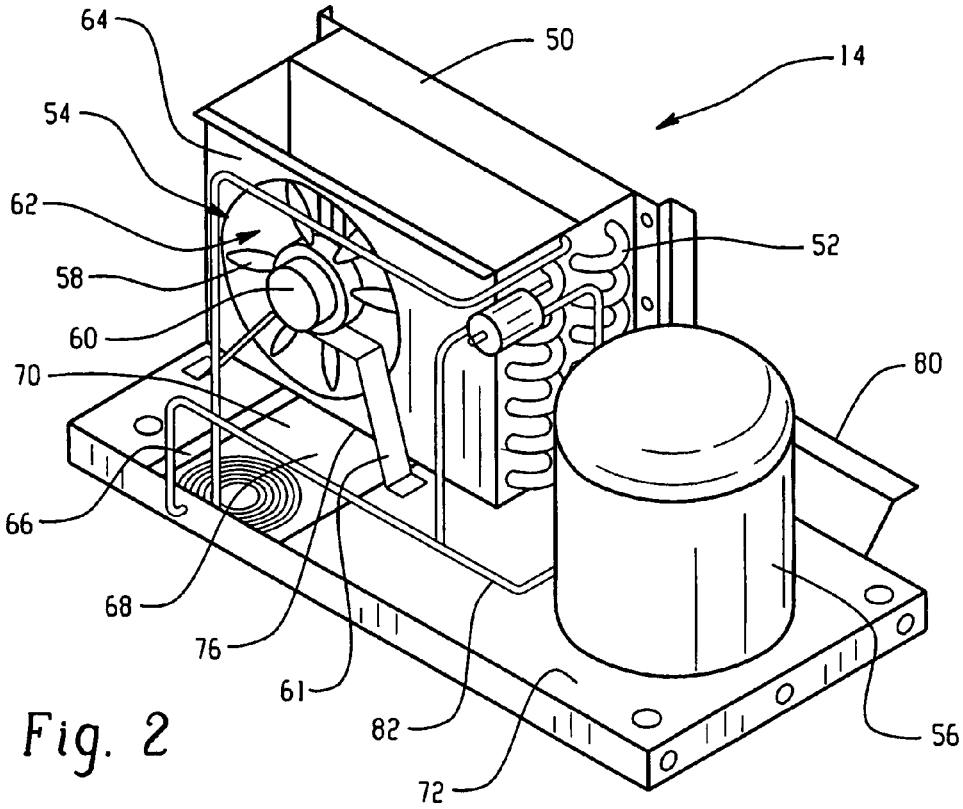
FIG. 2 is a perspective view of an embodiment of a condenser assembly for the refrigeration module of FIG. 1.
Figure 3:
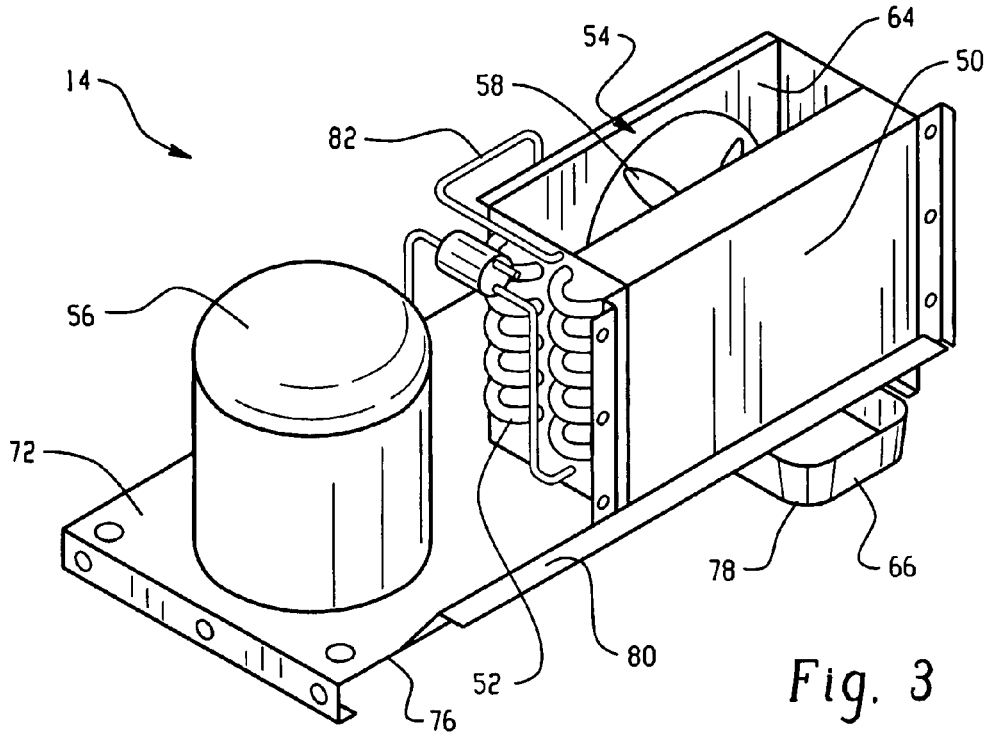
FIG. 3 is another perspective view of the condenser assembly of FIG. 2.
Figure 6:
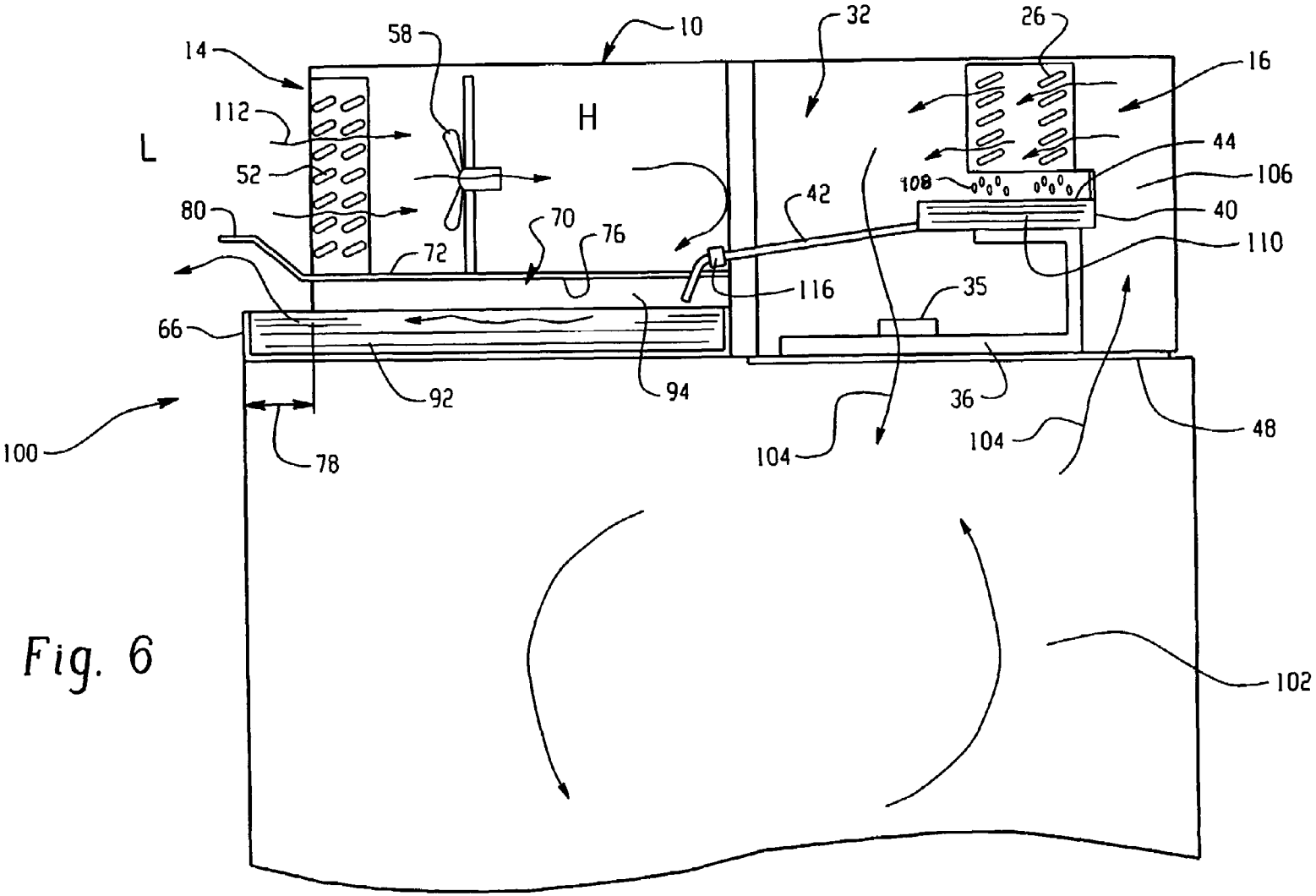
FIG. 6 is a schematic side view of a refrigeration appliance.

Referring also to FIGS. 2 and 3, condenser assembly 14 includes a coil support 50 through which condenser coils 52 pass, a condenser fan assembly 54 and a compressor 56. While FIGS. 2 and 3 show coil support 50 as solid, the coil support actually includes many inlet and outlet openings that allow for circulation of air about the condenser coils 52 (FIG. 1). Condenser fan assembly 54 includes a condenser fan 58 and a motor 60 that are supported by a bracket 61 within an opening 62 extending through shroud 64. Conduit 82 connects the condenser assembly 14 to the evaporator assembly 16. Conduit 82 carries refrigerant that is used to pick up heat from air circulated through a refrigeration space within a cabinet 102 of the appliance 100 (FIG. 6).

Figure 5:
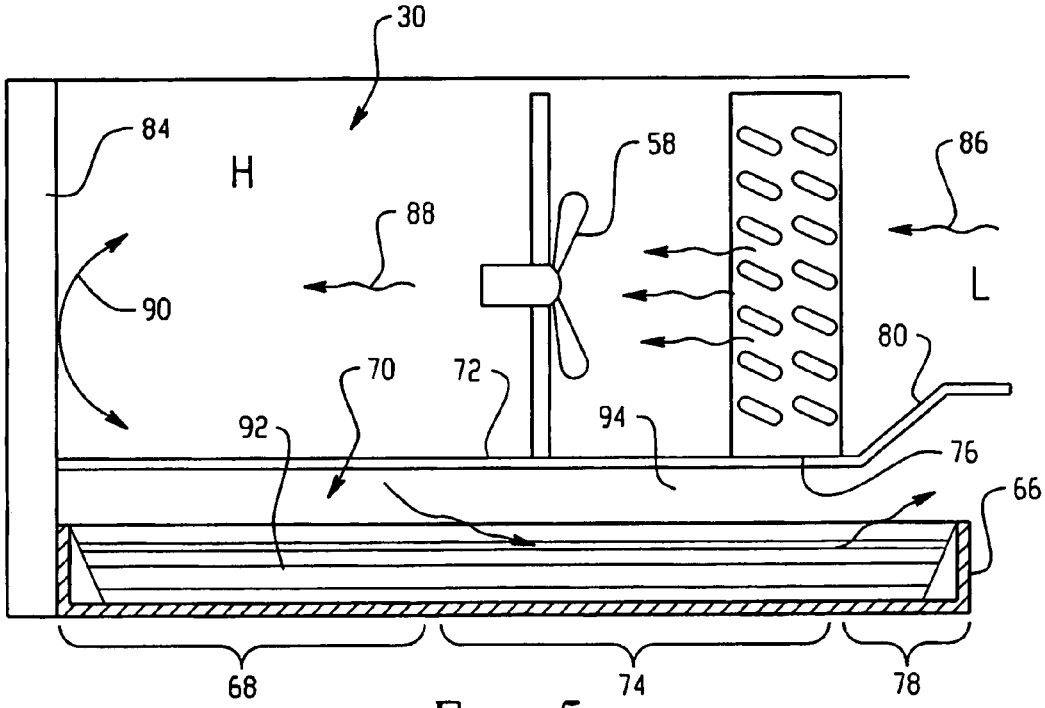
FIG. 5 is a diagrammatic side section view along line 5—5 of FIG. 4.

Condensate pan 66 is partially located beneath the condenser assembly 14. Condensate pan 66 receives condensate flowing from the drain conduit 42 of the drain pan 44 (FIG. 1). The first portion 68 of the condensate pan 66 is exposed to the first chamber 30 through an opening 70 that extends through a base plate 72 of the condenser assembly 14 (FIG. 2). An intermediate portion 74 of the condensate pan 66 extends beneath a bottom wall 76 (FIG. 5) of the coil support 50 (and/or base plate 72) and the second portion 78 of the condensate pan 66 extends beyond the base plate 72 (FIGS. 1, 3 and 5). A hood 80 extends outwardly from the base plate 72 and provides a cover spaced vertically from the condensate pan 66.

In general operation of the refrigeration module 10, power is supplied to the compressor 56 and fan motors 35, 60. Refrigerant gas is compressed by the compressor 56, increasing the temperature of the refrigerant. The heated refrigerant gas travels through the conduit 82 and enters the condenser coils 52 of the condenser assembly 14 where the refrigerant is condensed to a liquid by, in part, conducting the heat through the condenser coils to the ambient air as the condenser fan 58 directs air over the condenser coils. As can be seen by FIG. 2, a portion of conduit 82 is located in the condensate pan 66 to assist in evaporation of condensate disposed therein. From the condenser assembly 14, the liquid refrigerant enters the evaporator coils 26 of evaporator assembly 16 located in separate insulate space 32. Air is directed over the evaporator coils 26 by the evaporator fan 35 to cool the air. The cooled air is then directed to the refrigeration cabinet of the refrigeration appliance. The refrigerant within the evaporator coil used to cool the air is evaporated due to the heat transferred from the air. The heated refrigerant gas is directed back to the compressor 56 through the conduit 82.

Moisture condenses on the evaporator assembly 16 as the air is cooled. As the moisture collects on the evaporator assembly 16 it drips into the drain pan 44 (e.g., when refrigeration module 10 is used in a refrigerator that cools the air to a temperature above the freezing temperature for the condensate). The moisture is collected in the drain pan 44 and then directed by gravity to the condensate pan 66 through the drain conduit 42 (FIG. 1). In some embodiments, such as when using the refrigeration module 10 in a freezer, moisture may freeze on the evaporator assembly 16. In these embodiments, the moisture may not drip from the evaporator assembly 16 until adequately thawed, e.g., during a defrost cycle.

Figure 4:
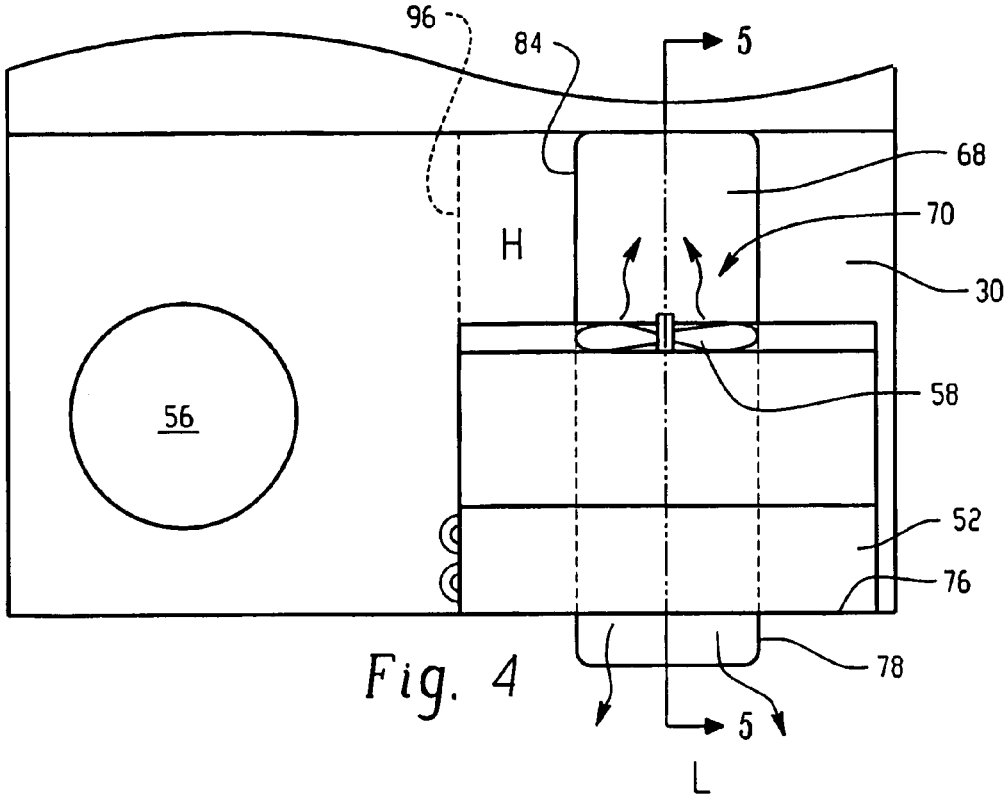
FIG. 4 is a diagrammatic top section view of the refrigeration assembly of FIG. 1.

Referring now to FIG. 4, high H and low L pressure regions are utilized to further enhance condensate evaporation. High pressure region H is developed in the compartment 30 through use of condenser fan 58. Condenser fan 58 draws air from outside the compartment 30, through coil support 50 that houses the condenser coils 52 and directs the air over portion 68 of the condensate pan 66 exposed through opening 70 and upon a wall 84. At least some of the air impinging upon the wall 84 is directed downward through the opening 70 in the base plate 72, along an air flow path formed between portion 74 of the condensate pan 66 and coil support 50 and/or base plate 72 and toward portion 78 of the condensate pan 66 that is exposed to lower, atmospheric pressure L.

Referring to FIG. 5, a schematic representation of the air flow path of at least some of the air drawn in by condenser fan 58 includes a path portion (shown by arrow 86) passing through the coil support 50 toward the condenser fan and another portion (shown by arrow 88) extending from the condenser fan and toward the wall 84. Air impinging upon the wall 84 is directed downward along a portion (shown by arrow 90) toward the first portion 68 of the condensate pan 66 and through opening 70 where air impinges upon condensate 92 disposed in the condensate pan. Due to the relatively high volume of air drawn into the compartment 30, pressure within the compartment is relatively high compared to atmospheric pressure. Air then travels along a partially enclosed, tunnel-like air flow passageway 94 formed between intermediate portion 74 of the condensate pan and the housing 52 and/or base plate 72 toward second portion 78 of the condensate pan 66. Evaporated condensate is collected by the air flowing over the condensate pan 66 and then carried out to the atmosphere.

FIG. 6 shows the refrigeration module 10 being used to cool a refrigeration cabinet 102 of an appliance 100. Fan 35 draws air 104 from the refrigeration cabinet 102 into the insulated compartment 32 along an air path 106 and circulates the air about the evaporator coils 26 in a heat exchange relationship. Heat is carried away from the air 104 by cooled refrigerant in the evaporator coils 26 and the cooled air is directed back into the cabinet 102 by the fan 35. As the air 104 is cooled, moisture from the air condenses on the evaporator coils 26 such that the moisture falls therefrom in the form of droplets 108. Drip pan assembly 40 is positioned under the evaporator coils 26 to receive the droplets. Once an amount of condensate 110 has been received by the drip pan assembly 40, the condensate is directed to the condensate pan 66 through drain conduit 42. Drain conduit 42 is slanted downward toward the condensate pan 66 to facilitate movement of the condensate from the drip pan 40. A check valve 116 may be used to control condensate flow through the drain conduit 42. The check valve 116 can inhibit unwanted backflow of the condensate, for example, due to the relatively high pressure condition within compartment 30.

As described above, the condensate is directed to the condensate pan 66 to remove the accumulated condensate from the system through evaporation. Evaporation of the condensate 92 is facilitated by exposing the condensate pan 66 to both a high pressure region H within compartment 30 and lower, ambient pressure L outside the compartment 30 to create a pressure gradient along the condensate pan. This pressure gradient is generated through use of the condenser fan 58, which draws air 112 in from the atmosphere, removing heat from the condenser coils 52. The volume of air 112 brought into compartment 30 generates relatively high pressure within the compartment 30. First portion 68 of the condensate pan 66 is exposed to the high pressure through opening 70. The heated air 112 is directed through the opening 70, along the air passageway 94 formed between bottom wall 76 and the condensate pan 66 and toward second portion 78 that is exposed to the atmosphere beneath hood 80.

Because portion 78 is exposed to lower, atmospheric pressure, the pressure gradient tends to increase air flow from within compartment 30 through the passageway 94 toward the low pressure region L. This increased air flow rate can increase the evaporation rate of the condensate 92 located in the condensate pan 66. Additionally, because air carrying moisture from the condensate pan 66 flows directly from the condensate pan to the atmosphere, air with relatively low amounts of moisture (i.e., relatively dry air) can continuously be directed over the condensate pan (as opposed to circulating air with high moisture content over the condensate pan) which can further improve condensate evaporation. In some instances, hood 80 may serve as an air flow barrier to inhibit rapid recirculation of the relatively moist air exiting through the passageway 94 and entering the atmosphere.

It is to be clearly understood that the above description is intended by way of illustration and example only and is not intended to be taken by way of limitation. For example, FIG. 4 shows an alternative embodiment having a divider wall 96 (shown by dotted lines) for decreasing the size of the first compartment 30. Other changes and modifications could be made.

What is claimed is:

1. A refrigeration unit comprising:

an evaporator assembly including an evaporator coil forming a first part of a refrigerant path;

a condenser assembly at least partially disposed in a compartment in a housing, the condenser assembly including a condenser coil forming a second part of the refrigerant path; and a condensate pan arranged and configured to receive condensate having dropped from the evaporator assembly;

wherein the condensate pan has a first portion that is exposed to pressure conditions in the compartment and a second portion that is spaced away from the compartment and exposed to ambient pressure.

2. The refrigeration unit of claim 1 further comprising a condenser fan for drawing air past the condenser coil.

3. The refrigeration unit of claim 2, wherein a pressure condition within the compartment is greater than ambient pressure during operation of the fan such that air flow is increased from the compartment along a path from the first portion of the condensate pan to the second portion of the condensate pan to increase evaporation of condensate in the condensate pan.

4. The refrigeration unit of claim 3 further comprising a wall in part defining the compartment wherein air flowing from the condenser fan impinges upon the wall during operation of the condenser fan.

5. The refrigeration unit of claim 4, wherein at least some of the air impinging on the wall is directed downward toward the first portion of the condensate pan and to the path from the first portion of the condensate pan to the second portion of the condensate pan.

6. The refrigeration unit of claim 2 further comprising a cover in part defining the compartment, the cover releasably engaging the housing.

7. The refrigeration unit of claim 2, wherein the condenser assembly further comprises a base that carries the condenser coil and the fan, the condensate pan being exposed through an opening extending through the base.

8. The refrigeration unit of claim 7, wherein the condensate pan and the condenser assembly define an air flow path for directing air flowing through the opening to the second portion of the condensate pan.

9. The refrigeration unit of claim 1, wherein the condenser assembly further comprises a compressor.

10. The refrigeration unit of claim 1 further comprising a drip pan arranged and configured to receive condensate dropping from the evaporator coil, the drip pan capable of fluid communication with the condensate pan.

11. The refrigeration unit of claim 1 further comprising a hood that covers the second portion of the condensate pan, the hood being spaced apart from the second portion of the condensate pan to expose the second portion to ambient pressure.

12. A refrigeration cabinet comprising the refrigeration unit of claim 1 and a cabinet housing defining at least one cooling cavity, the refrigeration unit of claim 1 being mounted at the top of the cabinet housing for delivering cooled air to the cooling cavity.

13. A refrigeration unit comprising:

an evaporator assembly including an evaporator coil forming a first part of a refrigerant path;

a condenser assembly at least partially disposed in a compartment in a housing, the condenser assembly including a condenser coil forming a second part of the refrigerant path and a condenser fan for drawing air past the condenser coil; and a condensate pan arranged and configured to receive condensate having dropped from the evaporator assembly, the condensate pan having a first portion exposed to the compartment that is at the downstream side of the condenser fan, wherein operation of the condenser fan creates an increased pressure condition in the compartment, a second portion of the condensate pan being spaced away from the compartment and exposed to ambient atmosphere such that the first portion of the condensate pan is exposed to the increased pressure condition and the second portion of the condensate pan is exposed to lower ambient pressure.

14. The refrigeration unit of claim 13 further comprising a wall in part defining the compartment wherein air flowing from the fan impinges upon the wall.

15. The refrigeration unit of claim 14 further comprising a cover in part defining the compartment, the cover releasably connected to the housing.

16. The refrigeration unit of claim 13 further comprising a drip pan arranged and configured to collect condensate dropping from the evaporator coil, the drip pan capable of fluid communication with the condensate pan.

17. The refrigeration unit of claim 13, wherein the condenser assembly further comprises a base that carries the condenser coil and the condenser fan, the condensate pan being exposed through an opening extending through the base.

18. The refrigeration unit of claim 17, wherein the condensate pan and the condenser assembly define an air flow path for directing air flowing through the opening to the second portion of the condensate pan.

19. The refrigeration unit of claim 13, wherein the second portion of the condensate pan is covered by a hood extending beyond the base, the hood being spaced-apart from the second portion of the condensate pan such that the second portion of the condensate pan is exposed to the lower ambient pressure.

20. A method of evaporating moisture collected in a condensate pan of a refrigeration unit including an evaporator assembly including an evaporator coil and a condenser assembly including a condenser coil at least partially disposed in a housing, the method comprising:

exposing a first portion of the condensate pan to a high pressure condition within a compartment at least partially housing the condenser assembly, the condensate pan arranged and configured to receive moisture having dripped from the evaporator assembly during a refrigeration operation; and exposing a second portion of the condensate pan to ambient pressure creating a pressure gradient across the condensate pan by spacing the second portion from the compartment.

21. The method of claim 20 further comprising directing condensate from a drip pan receiving condensate from the evaporator coil to the condensate pan.

22. The method of claim 20 further comprising generating a pressure condition in the compartment having a higher pressure than ambient pressure using a fan while drawing air past the condenser coil.

23. The method of claim 22 further comprising directing air flowing from the fan along an air path at least partially defined between the condensate pan and the condenser assembly and extending between the first and second portions.

* * * * *